US006407537B2

(12) United States Patent
Antheunis

(10) Patent No.: US 6,407,537 B2
(45) Date of Patent: Jun. 18, 2002

(54) VOLTAGE REGULATOR PROVIDED WITH A CURRENT LIMITER

(75) Inventor: Roland Albert Bertha Antheunis, Nijmegen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/741,723

(22) Filed: Dec. 19, 2000

(30) Foreign Application Priority Data

Dec. 21, 1999 (EP) ..... 99204453

(51) Int. Cl.[7] ..... G05F 3/08; G05F 3/16; G05F 3/20

(52) U.S. Cl. ..... 323/312; 323/317; 323/316

(58) Field of Search ..... 323/312, 313, 323/314, 315, 317

(56) References Cited

U.S. PATENT DOCUMENTS

| | | | | |
|---|---|---|---|---|
| 3,612,984 A | * | 10/1971 | Davis | 323/314 |
| 3,900,790 A | * | 8/1975 | Ohsawa | 330/296 |
| 4,292,584 A | * | 9/1981 | Kusakabe | 323/316 |
| 4,349,778 A | * | 9/1982 | Davis | 323/314 |
| 4,413,226 A | * | 11/1983 | Davies | 323/303 |
| 4,435,678 A | * | 3/1984 | Joseph et al. | 323/273 |
| 4,739,246 A | * | 4/1988 | Thomson | 323/273 |
| 4,868,483 A | * | 9/1989 | Tsujimoto | 323/313 |
| 4,868,485 A | * | 9/1989 | Ashizaki | 323/316 |

FOREIGN PATENT DOCUMENTS

JP 2136029 A 5/1990 ..... H02H/9/02

* cited by examiner

*Primary Examiner*—Bao Q. Vu
(74) *Attorney, Agent, or Firm*—Aaron Waxler

(57) ABSTRACT

A voltage regulator for converting an input voltage ($V_i$) into an output voltage ($V_o$). The input voltage may be burdened with a ripple. The output voltage ($V_o$) supplied by the voltage regulator is virtually free from ripple. The voltage regulator comprises an input terminal (1) for receiving the input voltage ($V_i$), an output terminal for supplying the output voltage ($V_o$) in response to the input voltage ($V_i$), and current limiting means for limiting the maximum absolute value of an output current ($I_o$) taken from the output terminal (2). The current limiting means comprise a field effect transistor ($T_{CL}$). The voltage regulator further comprises a first current mirror ($CM_1$) comprising transistors ($T_{11}$, $T_{12}$), a second current mirror ($CM_2$) comprising transistors ($T_{13}$, $T_{14}$), and a third current mirror comprising transistors ($T_{15}$, $T_{16}$). In a typical operation, the field effect transistor ($T_{CL}$) is in the linear region and thus behaves like a resistance. With an increasing output current ($I_o$), the current through the field effect transistor ($T_{CL}$) also increases, and the voltage between the drain and the source of the field effect transistor ($T_{CL}$) increases. When the voltage between the drain and the source of the field effect transistor ($T_{CL}$) has exceeded a certain level, the field effect transistor ($T_{CL}$) enters its saturation region and accordingly behaves like a constant-current source. As a consequence the output current ($I_o$) can no longer rise.

3 Claims, 2 Drawing Sheets

VOLTAGE REGULATOR PROVIDED WITH A CURRENT LIMITER

Figure 1:
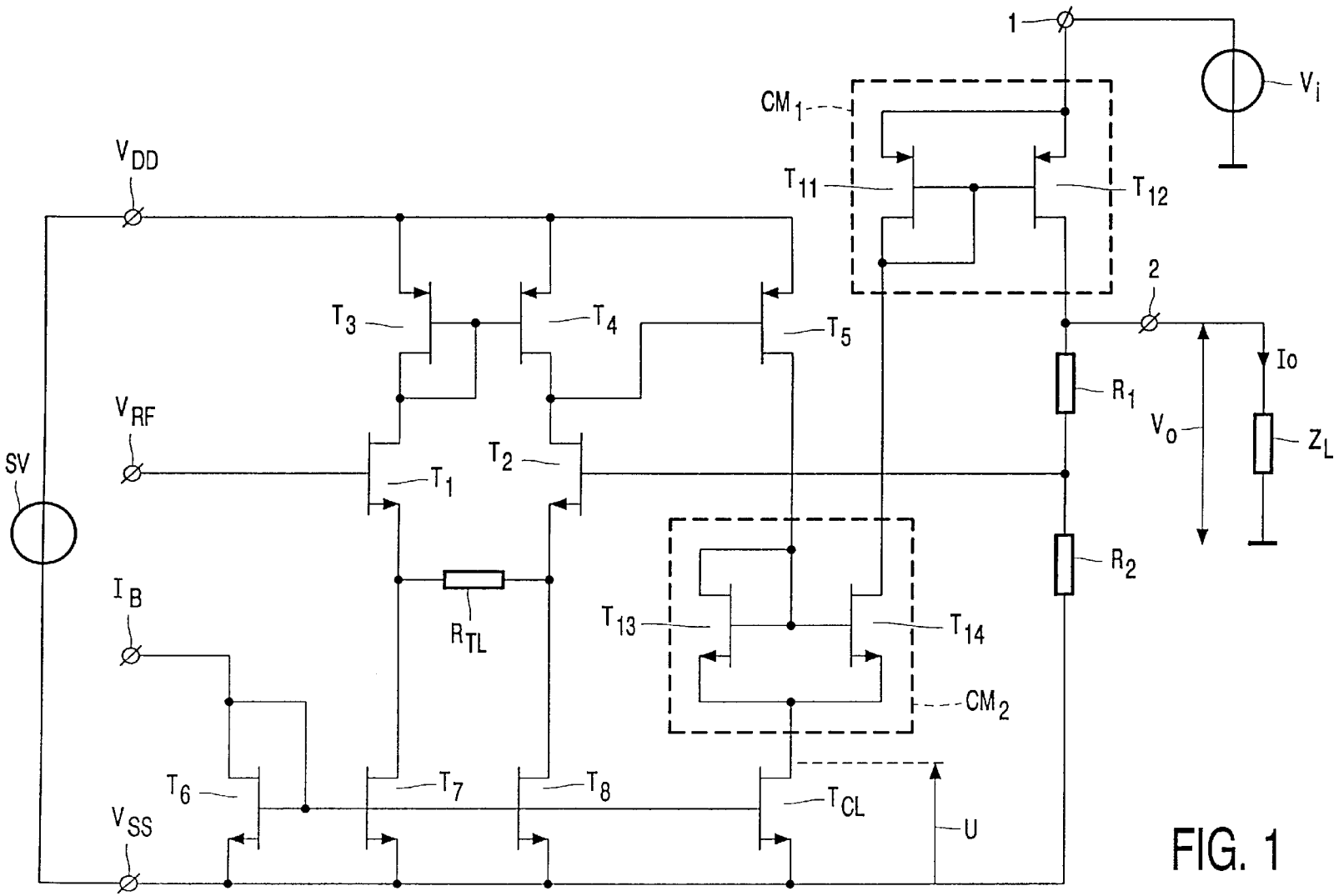

The invention relates to a voltage regulator for converting an input voltage, which may be affected by a ripple, into an output voltage which is substantially not affected by a ripple, comprising an input terminal for receiving the input voltage, an output terminal for supplying the output voltage in response to the input voltage, and current limiting means for limiting the maximum absolute value of an output current supplied from the output terminal.

Such a voltage regulator is known from Japanese patent abstract JP 2-136029 A. The known voltage regulator comprises a current mirror with an input and an output and, a bipolar transistor whose base is connected to the current mirror and whose emitter forms the output terminal of the voltage regulator. The known voltage regulator further comprises a voltage divider which consists of two resistors connected in series. The voltage divider is connected between the emitter of the bipolar transistor and a supply voltage terminal. The known voltage regulator further comprises a comparator, a first current source which supplies a comparatively small current, and a second current source which supplies a comparatively large current. A switch is connected in series with the second current source. The comparator is connected by a first input to the common junction point of the two resistors connected in series, and is connected by a second input to a reference voltage source, and is connected by an output to a control electrode of the switch. In a normal operational state of the voltage regulator, the switch is in the conducting state. The current supplied to the input of the current mirror in that case is determined by the sum of the currents supplied by the first and the second current source. This current is delivered from the output of the current mirror to the base of the bipolar transistor. The bipolar transistor amplifies this current and delivers the amplified current to the voltage divider. As the current through the voltage divider rises, the voltage at the first input of the comparator will become greater than the voltage at the second input of the comparator at a given moment. As a result of this, the voltage at the output of the comparator changes, such that the switch switches from the conducting state to a non-conducting state. In this state, the current supplied to the input of the current mirror is dependent on the first current source only. As a result, the current supplied from the output of the current mirror is reduced, so that the current supplied from the emitter of the bipolar transistor to the voltage divider is limited.

A disadvantage of the known voltage regulator is that the current limitation is achieved in a comparatively complicated manner.

It is an object of the invention to provide a voltage regulator which reduces the above mentioned disadvantage.

According to the invention, the voltage regulator mentioned in the opening paragraph is for this purpose characterized in that the current limiting means comprise a current limiting transistor with a main current path, and in that the current limiting means are designed such that, if the voltage across the main current path is higher than a given threshold voltage of the current limiting transistor, at which the current limiting transistor acts as a current source, the maximum absolute value of the output current is limited.

The invention is based on the recognition that the transistor is in its linear operational range as long as a voltage across the main current path of a transistor lies below a certain limit, so that the transistor behaves as a resistor, and on the recognition that, as the voltage across the main current path rises, there comes a moment when the voltage across the main current path exceeds said limit, so that the transistor starts behaving as a current source. The transistor thus acts as a current limiting transistor. The current limiting transistor may be constructed, for example, with a field effect transistor. When the drain-source voltage of the field effect transistor is smaller than the difference between the gate-source voltage and the so-called threshold voltage $V_t$, the field effect transistor is in its linear operational range. When the drain-source voltage of the field effect transistor is higher than the difference between the gate-source voltage and the so-called threshold voltage Vt, the field effect transistor is in its saturation range, wherein the field effect transistor acts as a constant-current source. The current limiting transistor may alternatively be constructed with a bipolar transistor. When the collector-emitter voltage of the bipolar transistor is below the so-called saturation voltage, the transistor is in saturation and behaves more or less as a resistor. When the collector-emitter voltage of the bipolar transistor is greater than the so-called saturation voltage, the bipolar transistor is not in the saturated state. The bipolar transistor then acts as a constant-current source.

Further advantageous embodiments of the invention are defined in claims 2 and 3.

Figure 2:
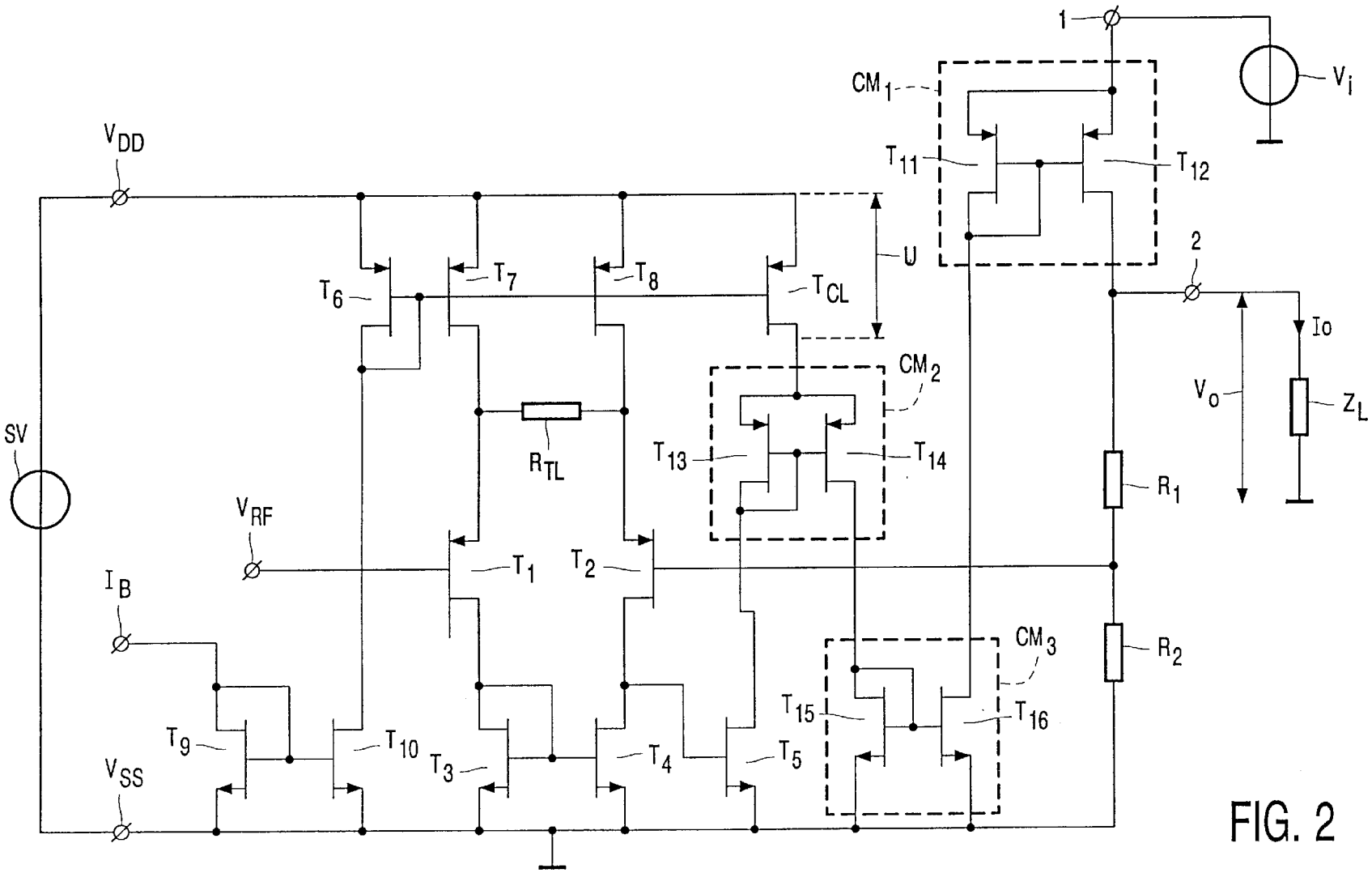

The invention will be explained in more detail with reference to the attached drawing, in which:

FIG. 1 is a circuit diagram of a first embodiment of a voltage regulator according to the invention; and FIG. 2 is a circuit diagram of a second embodiment of a voltage regulator according to the invention.

Corresponding components or elements have been given the same reference symbols in these Figures.

FIG. 1 shows a circuit diagram of a first embodiment of a voltage regulator according to the invention. The voltage regulator is supplied from a supply voltage source SV which is connected between a supply voltage terminal $V_{SS}$ and a further supply voltage terminal $V_{DD}$. The voltage regulator has an input terminal 1 for receiving an input voltage $V_i$ and an output terminal 2 for supplying an output voltage $V_o$ in response to the input voltage $V_i$. A load $Z_L$ is connected between the output terminal 2 and the supply voltage terminal $V_{SS}$. An output current $I_o$ supplied from the output terminal 2 flows through the load $Z_L$. The voltage regulator further comprises a first current mirror $CM_1$ with field effect transistors $T_{11}$ and $T_{12}$, a second current mirror $CM_2$ with field effect transistors $T_{13}$ and $T_{14}$, field effect transistors $T_1$ to $T_8$, current limiting field effect transistor $T_{CL}$, tail resistor $R_{TL}$, and a voltage divider which is implemented with a series arrangement of a resistor $R_1$ and a resistor $R_2$, which series arrangement is connected between the output terminal 2 and the supply voltage terminal $V_{SS}$. The gates of transistors $T_{11}$ and $T_{12}$ and the drain of transistor $T_{11}$ are interconnected and form the input of the first current mirror $CM_1$. The drain of transistor $T_{12}$ forms the output of the first current mirror $CM_1$ and is connected to the output terminal 2. The sources of transistors $T_{11}$ and $T_{12}$ are interconnected and form a reference connection point of the first current mirror $CM_1$ and are connected to the input terminal 1. The gates of transistors $T_{13}$ and $T_{14}$ and the drain of transistor $T_{13}$ are interconnected and form the input of the second current mirror $CM_2$. The drain of transistor $T_{14}$ forms the output of the second current mirror $CM_2$ and is connected to the input of the first current mirror $CM_1$. The sources of transistors $T_{13}$ and $T_{14}$ are interconnected and form a reference connection point of the second current mirror $CM_2$. The sources of transistors $T_6$, $T_7$, $T_8$ and of current limiting transistor $T_{CL}$ are connected to the supply voltage terminal $V_{SS}$. The drain of transistor $T_6$ and the gates of transistors $T_6$, $T_7$, $T_8$ and of the current limiting transistor $T_{CL}$ are connected to a current reference terminal $T_{13}$. The drain of current limiting transistor $T_{CL}$ is connected to the reference connection point of the second current mirror $CM_2$. The sources of transistors $T_3$, $T_4$, and $T_5$ are connected to the further supply voltage terminal $V_{DD}$. The drain of transistor $T_3$ and the gates of transistors $T_3$ and $T_4$ are connected to the drain of transistor $T_1$. The gate of transistor $T_1$ is connected to a voltage reference terminal $V_{RF}$. The source of transistor $T_1$ is connected to the drain of transistor $T_7$. The drain of transistor $T_4$ and the gate of transistor $T_5$ are connected to the drain of transistor $T_2$. The source of transistor $T_2$ is connected to the drain of transistor $T_8$. The tail resistor $R_{TL}$ is connected between the source of transistor $T_1$ and the source of transistor $T_2$. The gate of transistor $T_2$ is connected to the common junction point of the resistors $R_1$ and $R_2$.

The circuit operates as follows. The voltage across the resistor $R_2$ is controlled so as to be equal to the reference voltage which is offered between the voltage reference terminal $V_{RF}$ and the supply voltage terminal $V_{SS}$. As a result of this, the output voltage $V_o$ between the output terminal 2 and the supply voltage terminal $V_{SS}$ is equal to said reference voltage multiplied by the sum of the values of the resistors $R_1$ and $R_2$ and divided by the value of resistor $R_2$. Since the reference voltage is free from ripple, the output voltage $V_o$ is also free from ripple. The ripple which may be present on the input voltage Vi accordingly does not extend itself to the output voltage $V_o$. For an optimum operation, however, the input voltage $V_i$ should always be greater than the output voltage $V_o$. As long as the voltage regulator is in a normal operating condition, i.e. no current limitation takes place, the output current $I_o$ will rise as the impedance of the load $Z_L$ decreases. In this normal operating condition, the current limiting transistor $T_{CL}$ is in its linear operating range. The current limiting transistor $T_{CL}$ thus acts as a resistor. As the output current $I_o$ rises, there will come a moment when the voltage U between the drain and the source of the current limiting transistor $T_{CL}$ becomes so great that the current limiting transistor $T_{CL}$ changes from its linear operating range to its so-called saturation region. The current limiting transistor $T_{CL}$ acts as a constant current source as a result of this. The current which is supplied by transistor $T_5$ cannot be controlled upwards any further because in that case the potential at the drain of transistor $T_5$ will rise quickly, which will render the source-drain voltage of transistor $T_5$ so low that the transistor $T_5$ changes from the saturation region to the linear operating region. Since the current to the input of the second current mirror $CM_2$ is limited thereby, the output current $I_o$ is also limited via the second current mirror $CM_2$ and via the first current mirror $CM_1$. The tail resistor $R_{TL}$ serves to improve the stability of the voltage regulator, so that there is no risk of undesirable oscillations occurring.

FIG. 2 shows a circuit diagram of a second embodiment of a voltage regulator according to the invention. An advantage of this second embodiment over the first embodiment of FIG. 1 is that the reference voltage between the voltage reference terminal $V_{RF}$ and the supply voltage terminal $V_{SS}$ may be chosen to be lower. For this purpose, all transistors having a p-conductivity type are replaced by transistors having an n-conductivity type, except for transistors $T_{11}$ and $T_{12}$, and all transistors having an n-conductivity type are replaced by transistors having a p-conductivity type. A third current mirror $CM_3$ is added, composed with field effect transistors $T_{15}$ and $T_{16}$. The drain of transistor $T_{15}$ and the gates of transistors $T_{15}$ and $T_{16}$ are interconnected and form the input of the third current mirror $CM_3$, which is connected to the output of the second current mirror $CM_2$. The drain of transistor $T_{16}$ forms the output of the third current mirror $CM_3$ and is connected to the input of the first current mirror $CM_1$. The sources of transistors $T_{15}$ and $T_{16}$ are interconnected and form a reference connection terminal of the third current mirror $CM_3$, which is connected to the supply voltage terminal $V_{SS}$ of the voltage regulator.

The operation of the circuit of FIG. 2 is equivalent to the operation of the circuit of FIG. 1.

A further advantage of a voltage regulator according to the invention is that the output voltage $V_o$ can be substantially equal to the input voltage $V_i$.

The differential pair $T_1$, $T_2$ may be replaced by some other type of differential stage, for example a cascoded differential stage. The voltage regulator may either be constructed from discrete components or be implemented in an integrated circuit. The voltage regulator may be constructed with field effect transistors as well as with bipolar transistors. A combination of field effect transistors and bipolar transistors may also be used. It is also possible to replace all p-type transistors with n-type transistors, provided all n-type transistors are replaced with p-type transistors at the same time.

What is claimed is:

1. A voltage regulator for converting an input voltage ($V_i$), which may be affected by a ripple, into an output voltage ($V_o$) which is substantially not affected by a ripple, comprising an input terminal (1) for receiving the input voltage ($V_i$), an output terminal (2) for supplying the output voltage ($V_o$) in response to the input voltage ($V_i$), and current limiting means for limiting the maximum absolute value of an output current ($I_o$) supplied from the output terminal (2), characterized in that the current limiting means comprise a current limiting transistor ($T_{CL}$) with a main current path, and in that the current limiting means are designed such that, if the voltage (U) across the main current path is higher than a given threshold voltage of the current limiting transistor ($T_{CL}$), at which the current limiting transistor ($T_{CL}$) acts as a current source, the maximum absolute value of the output current ($I_o$) is limited, wherein the gate of the current limiting transistor ($T_{CL}$) is connected to a current reference terminal ($I_B$).

2. A voltage regulator as claimed in claim 1, characterized in that the current limiting means further comprise a first current mirror ($CM_1$) with an input, an output coupled to the output terminal (2) and a reference connection point which is coupled to the input terminal (1); and a second current mirror ($CM_2$) with an input, an output coupled to the input of the first current mirror ($CM_1$), and a reference connection point, and in that the main current path of the current limiting transistor ($T_{CL}$) is connected in series with the reference connection point of the second current mirror ($CM_2$) and a supply voltage terminal ($V_{SS}$) of the voltage regulator.

3. A voltage regulator as claimed in claim 1, characterized in that the current limiting means further comprise a first current mirror ($CM_1$) with an input, an output coupled to the output terminal (2) and a reference connection point which is coupled to the input terminal (1); a second current mirror ($CM_2$) with an input, an output, and a reference connection point; and a third current mirror ($CM_3$) with an input coupled to the output of the second current mirror ($CM_2$), an output coupled to the input of the first current mirror ($CM_1$), and a reference connection point which is coupled to the supply voltage terminal ($V_{SS}$) of the voltage regulator; and in that the current limiting transistor ($T_{CL}$) is connected in series with the reference connection point of the second current mirror ($CM_2$) and a further supply voltage terminal ($V_{DD}$) of the voltage regulator.

* * * * *